United States Patent [19]

Jeschke et al.

[11] 4,344,360

[45] Aug. 17, 1982

[54] INK DUCT FOR OFFSET OR LETTERPRESS PRINTING MACHINES

[75] Inventors: Willi Jeschke, Heidelberg; Rudi Jünghans, Wilhelmsfeld, both of Fed. Rep. of Germany

[73] Assignee: Heidelberger Druckmaschinen Aktiengesellschaft, Heidelberg, Fed. Rep. of Germany

[21] Appl. No.: 167,401

[22] Filed: Jul. 11, 1980

[30] Foreign Application Priority Data

Jul. 12, 1979 [DE] Fed. Rep. of Germany ..... 2928125

[51] Int. Cl.[3] ..... B41F 31/02

[52] U.S. Cl. ..... 101/363; 15/256.5; 101/365; 101/425; 118/261

[58] Field of Search ..... 101/363, 365, 350, 156, 101/168, 207, 208, 423, 425; 15/256.5, 256.51; 118/259, 261, 413

[56] References Cited

U.S. PATENT DOCUMENTS 2,382,103 8/1945 Sandman ..... 101/365
3,654,654 4/1972 Abreu et al. ..... 118/259 X
4,240,347 12/1980 Hazelton et al. ..... 101/168 X
4,242,958 1/1981 Jeschke ..... 101/363 X

FOREIGN PATENT DOCUMENTS 383413 1/1965 Switzerland .

*Primary Examiner*—Edgar S. Burr
*Assistant Examiner*—Moshe I. Cohen
*Attorney, Agent, or Firm*—Herbert L. Lerner; Laurence A. Greenberg

[57] ABSTRACT

Ink duct assembly for offset or letterpress printing machines having an ink duct and a duct roller defining an ink gap therebetween and an ink metering unit for adjusting the ink gap, respectively, zonewise in axial direction of the duct roller, including an elastic foil, the ink metering unit being engageable through the intermediary of the elastic foil with the duct roller, the elastic foil covering the ink metering unit and being removably fastened to the ink duct at an upper edge thereof and means for tangentially displacing the elastic foil relative to the duct roller to a position wherein a new and unworn part of the surface of the elastic foil engages with the duct roller.

2 Claims, 7 Drawing Figures

INK DUCT FOR OFFSET OR LETTERPRESS PRINTING MACHINES

The invention relates to an ink duct and, more particularly, to an ink duct assembly for offset or letterpress printing machines having an ink duct and a duct or fountain roller defining an ink gap therebetween and an ink metering unit by means of which the respective ink gap is adjustable zonewise in axial direction of the duct roller, the ink metering device being engageable through the intermediary of an elastic foil with the duct roller and being covered by the elastic foil which is fastened at the upper edge of the ink duct so as to be readily removable therefrom.

A heretofore known construction of an ink duct assembly (U.S. Pat. No. 2,382,103) employs spring clips for firmly clamping the foil to an upper edge of the ink duct. The foils which are used in this case are relatively stiff and must, therefore, be matched or conformed to the shape of the ink duct by folding. After a given operating period, the foil becomes worn at the engagement or contact surface thereof with the duct or fountain roller and must be replaced. The circular section or segment worn into the foil by the duct or fountain roller must not assume such proportions as to result in detachment of the leading end or region of the foil because, otherwise, soiling of the ink metering unit would occur. A disadvantage of this heretofore known construction of the ink duct assembly is that the ink duct must always be emptied and a new foil, respectively, is necessary for replacing the existing foil.

It is accordingly an object of the invention, to provide an ink duct assembly wherein the service life of the foil is extended or lengthened and wherein less emptying of the ink duct is accordingly necessary.

It is another object of the invention to provide such an ink duct assembly which will afford displacement or shifting of the foil in a relatively simple and economical manner.

With the foregoing and other objects in view, there is provided, in accordance with the invention, an ink duct assembly for offset or letterpress printing machines having an ink duct and a duct roller defining an ink gap therebetween and an ink metering unit for adjusting the ink gap, respectively, zonewise in axial direction of the duct roller, comprising an elastic foil, the ink metering unit being engageable through the intermediary of the elastic foil with the duct roller, the elastic foil covering the ink metering unit and being removably fastened to the ink duct at an upper edge thereof and means for tangentially displacing the elastic foil relative to the duct roller to a position wherein a new and unworn part of the surface of the elastic foil engages with the duct roller. It is thereby possible to shift or displace the foil repeatedly with respect to the duct or fountain roller and, thus lengthen or extend the service life thereof accordingly. Additional work incidental thereto, such as emptying of the ink duct, for example, is not required when shifting or displacing the foil.

In accordance with another feature of the invention, the foil displacing means comprise a turnable clamping spindle disposed in an upper region of the ink duct and extending over the length of the latter, the clamping spindle being formed with a longitudinal slot for securing an end of the elastic foil therein.

In accordance with a further feature of the invention, the ink duct assembly includes a plurality of parallel strips disposed in an upper region of the ink duct and extending over the length of the latter for respectively securing an end of the elastic foil.

In accordance with a concomitant feature of the invention, the foil displacing means comprise respective rods of varying shape and thickness insertable between the elastic foil and the strips at a location underlying the elastic foil and removable from the location as well as being turnable thereat about the longitudinal axis thereof.

Other features which are considered as characteristic for the invention are set forth in the appended claims.

Although the invention is illustrated and described herein as embodied in ink duct for offset or letter press printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
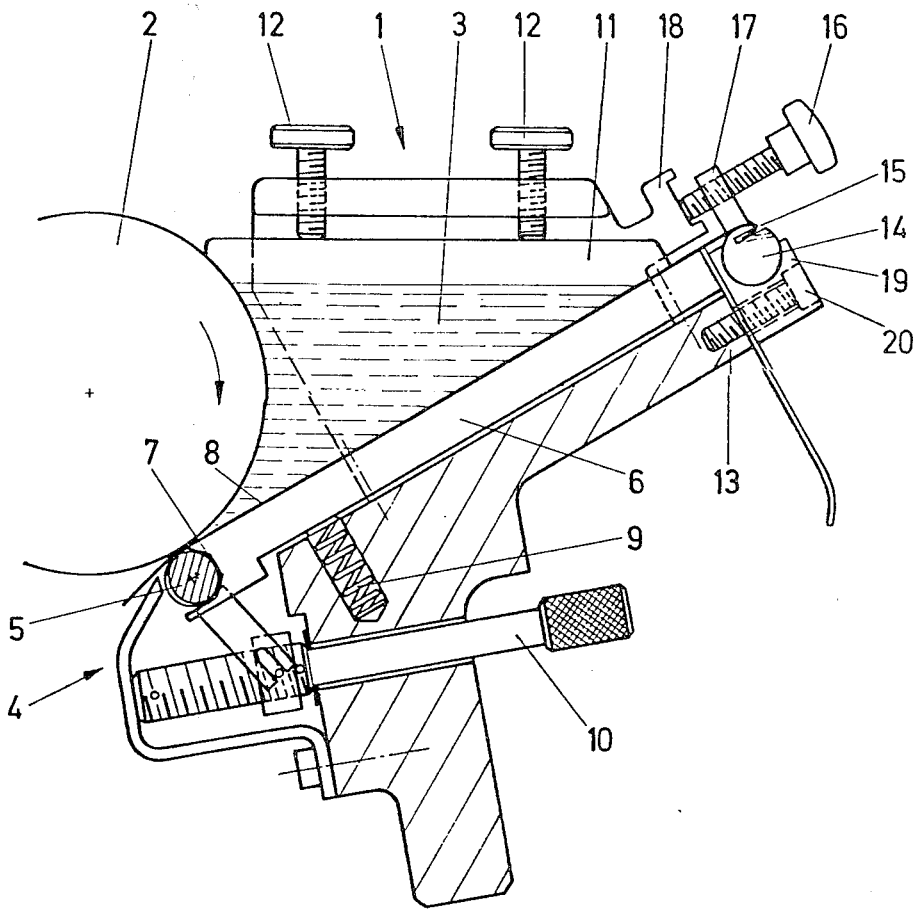
FIG. 1 is a cross-sectional view of an ink duct constructed in accordance with the invention.

Referring now to the drawing and first, particularly to FIG. 1 thereof, there is shown, as in conventional offset or letterpress printing machines, an ink duct 1 with which a fountain roller or duct roller 2 is associated, ink 3 filling a wedge-shaped space therebetween. The ink 3 is fed in thin film conventionally by the fountain roller 2 through the intermediary of a non-illustrated lifter or vibrator roller to inking-unit rollers (also not shown) and from the latter, in turn, to a non-illustrated plate cylinder of the printing machine. The thin ink film is able to be matched to respective requirements by an ink metering unit 4 (FIG. 1). The latter is of swing-away construction for cleaning the ink duct 1 and the fountain roller 2. The length of the ink duct 1 and the rollers is selected in accordance with the format or size of the paper which is to be printed on. The ink duct 1 and the rollers are supported on both sides thereof in non-illustrated side walls of a printing unit of the printing machine.

The ink metering device 4 is formed of a plurality zone-wide adjusting elements 5 disposed closely adjacent one another and extending over the width of the ink duct 1 i.e. perpendicularly to the plane of the drawing in FIG. 1. The adjusting elements 5 are of cylindrical construction and are mounted in zone-wise subdivided pressure bars 6. For this purpose, the pressure bars 6 are formed in a forward region thereof with respective recesses 7. Both, the adjusting elements 5 as well as the pressure bars 6, are covered by an elastic foil 8. Compression springs 9, respectively associated with each of the pressure bars 6, press the adjusting elements 5 against the elastic foil 8 and, thus, against the fountain roller 2, the desired ink gap between the fountain roller 2 and the elastic foil 8 at the respective adjusting elements 5 being adjustable zone-wise by respective adjusting of set screws 10. The elastic foil 8 is fastened at an upper region of the ink duct, and normally extends on both sides to below locking or closure members 11 which seal off the ink space 3 laterally and are firmly clamped by means of screws 12.

Figure 2:
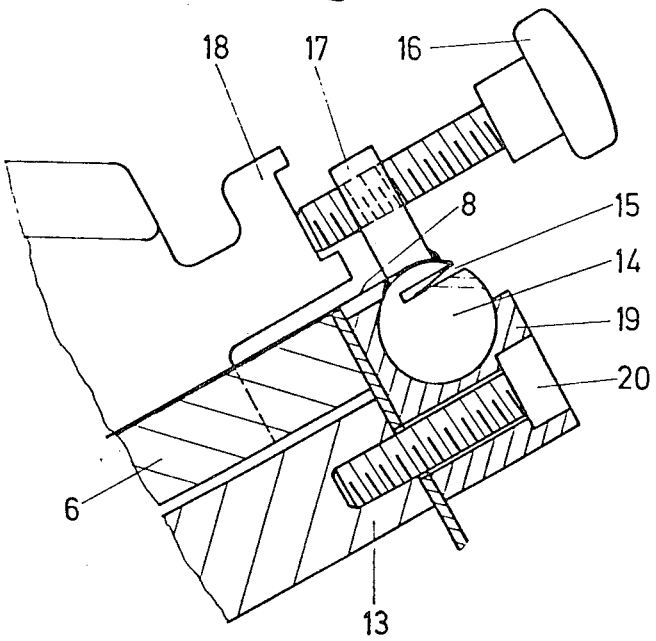
FIG. 2 is an enlarged fragmentary view of FIG. 1 showing one embodiments of a clamping device for an elastic foil of the ink duct.

At the upper edge 13 of the ink duct 1, the elastic foil 8 is suspended from or attached to a clamping spindle 14 which extends over the length of the ink duct 1. For this purpose, the clamping spindle 14 is formed with a longitudinal slot 15. By means of respective screws 16 and levers 17, the clamping spindle 14 is turnable so that the screws 16 are braced against lateral holders 18. A bearing 19 for the clamping spindle 14 is fastened by screws 20 to the upper edge 13 of the ink duct 1. When the clamping spindle 14 is turned, the elastic foil 8 is shifted or displaced tangentially to the fountain or duct roller 2 so that, after the foil 8 has been shifted or displaced, a new, unworn part of the foil surface engages the fountain roller 2. The elongated slot 15 for attaching the foil 8 might then assume the position thereof shown in phantom in FIGS. 1 and 2. When shifting or displacing the foil 8, the screws 12 for the lateral locking or closure members 11 must be loosened somewhat and, after the foil 8 has been shifted or displaced, must be retightened.

Figure 3:
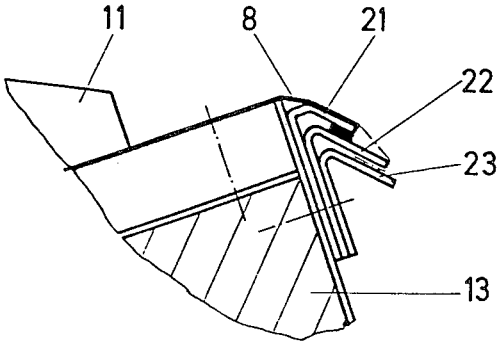
FIG. 3 is a view similar to that of FIG. 2 showing another embodiment of the clamping device.

In FIG. 3, there is shown an embodiment of the invention, wherein the elastic foil 8 is suspended from or attached to a rod formed as a strip or ledge 21 in the upper region of the ink duct 1. Additional strips or ledges 22, 23 are fastened to the ink duct 1 parallel to the first-mentioned strip or ledge 21 and extend over the length of the ink duct 1. To shift or displace the elastic foil 8 with respect to the fountain or duct roller 2, the foil 8, as shown in phantom, can, for example, be hooked to or suspended from the ledge or strip 22 so that a new, unworn part of the foil surface engages the fountain roller 2.

Figure 4:
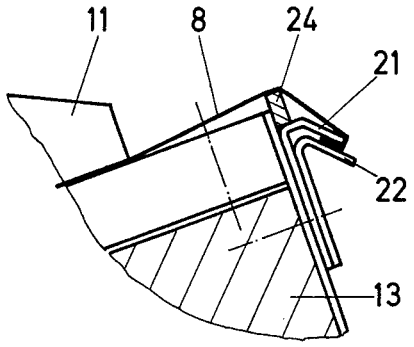
FIGS. 4 to 7 are views similar to that of FIG. 3 showing the embodiment thereof modified by provision of rods of varying cross section underlying the elastic foil.
Figure 5:
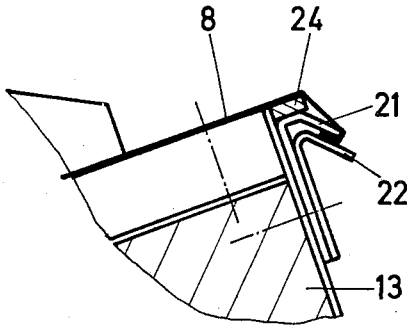

FIG. 4 shows the elastic foil 8, which is suspended from or attached to the strip or ledge 21, together with an underlying rod 24 having a rectangular cross section, the longer side of the rectangle being perpendicular to the foil 8, so that a relatively long path of shifting or displacement is attained. In FIG. 5, the rod 24 of rectangular cross section is turned down on its longer side so that the shift or displacement path of the foil 8 is relatively shorter. It is advantageous for a printer, above all, to effect the relatively shorter shift or displacement path.

Figure 6:
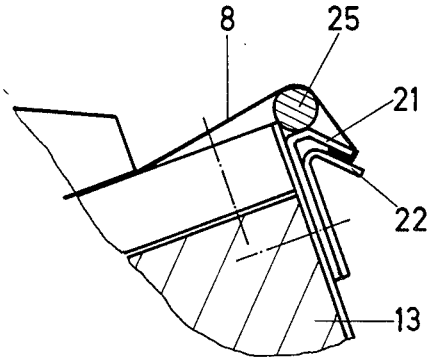
Figure 7:
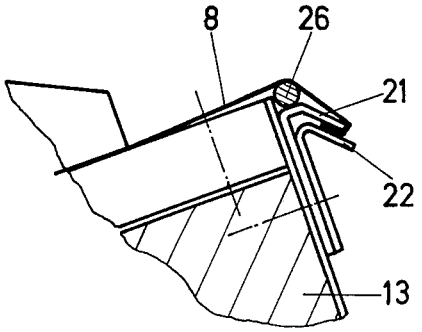

The same effect can be attained, as shown in FIG. 6, by sliding a round or circular rod 25 of relatively larger diameter under the foil 8. FIG. 7 shows a round or circular rod 26 of relatively smaller diameter by means of which any desired path of shift or displacement for the foil 8 can be attained. All of the rods, 24, 25 and 26, respectively, extend over the length of the ink duct 1 and, to facilitate introduction or insertion thereof, may be split in the middle so that respective halves of the rod length may be insertable from opposite sides of the ink duct 1. In this case, also, the screws 12 for the locking or closure members 11 must be loosened slightly and, after the shift or displacement has been completed, must be retightened. Instead of employing the embodiment according to FIGS. 1 and 2, it is possible for a printer to shift or displace the elastic foil 8 tangentially to the fountain or duct roller 2 by inserting beneath the foil 8 or removing therefrom rods of varying thickness and profile according to FIGS. 3 to 7 so that the object of the invention is achieved, as well, with these advantageous embodiments.

There are claimed:

1. Ink duct assembly for offset or letterpress printing machines having an ink duct and a duct roller defining an ink gap therebetween and an ink metering unit for adjusting the ink gap, respectively, zonewise in axial direction of the duct roller, comprising an elastic foil, the ink metering unit being engageable through the intermediary of said elastic foil with the duct roller, said elastic foil covering the ink metering unit and being removably fastened to the ink duct at an upper edge thereof, and means for tangentially displacing said elastic foil relative to the duct roller to a position wherein a new and unworn part of the surface of said elastic foil engages with the duct roller, said means for tangentially displacing said elastic foil including a plurality of parallel strips disposed in an upper region of the ink duct and extending over the length of the latter for respectively securing an end of said elastic foil.

2. Ink duct assembly according to claim 1 wherein said foil displacing means comprise respective rods of varying shape and thickness insertable between said elastic foil and said strips at a location underlying said elastic foil and removable from said location as well as being turnable thereat about the longitudinal axis thereof.

* * * * *